US007316548B2

(12) United States Patent
Jäger

(10) Patent No.: US 7,316,548 B2
(45) **Date of Patent: *Jan. 8, 2008**

(54) STATOR FOR AN ECCENTRIC SCREW PUMP OR AN ECCENTRIC WORM MOTOR OPERATING ON THE MOINEAU PRINCIPLE

(75) Inventor: Sebastian Jäger, Hannover (DE)

(73) Assignee: Artemis Kautschuk-und Kunststoff-Technik GmbH (DE)

( * ) Notice: Subject to any disclaimer, the term of this patent is extended or adjusted under 35 U.S.C. 154(b) by 75 days.

This patent is subject to a terminal disclaimer.

(21) Appl. No.: 10/725,967

(22) Filed: Nov. 17, 2003

(65) Prior Publication Data

US 2005/0106004 A1 May 19, 2005

(51) Int. Cl.
*F01C 1/10* (2006.01)
*F03C 2/00* (2006.01)
*F04C 18/00* (2006.01)

(52) U.S. Cl. ..... 418/48; 418/153; 418/178; 415/72; 415/73; 366/51; 138/138; 138/139; 166/236

(58) Field of Classification Search ..... 418/48, 418/153, 178; 415/72, 73, 76; 416/176, 416/177; 366/51; 138/138, 139, 143, DIG. 11; 166/236, 105; 175/107
See application file for complete search history.

(56) References Cited

U.S. PATENT DOCUMENTS 4,313,717 A * 2/1982 Kopecky ..... 418/48
5,171,138 A * 12/1992 Forrest ..... 418/48
5,171,139 A * 12/1992 Underwood et al. ..... 418/48
5,318,416 A * 6/1994 Hantschk et al. ..... 418/48

FOREIGN PATENT DOCUMENTS

DE 3119568 A1 * 12/1982
DE 3322095 A * 12/1984
DE 4403598 A1 * 8/1995
JP 61180512 A * 8/1986

* cited by examiner

*Primary Examiner*—Theresa Trieu
(74) *Attorney, Agent, or Firm*—Robert W. Becker; Robert W. Becker & Assoc.

(57) ABSTRACT

The invention relates to a stator for an eccentric screw pump or an eccentric worm motor having a stator, including an outer tube that is provided with a lining of rubber or a rubber-like material and has a hollow space, in the shape of a double or multiple spiral, for accommodating a rigid rotor that is also in the form of a spiral, whereby the spiral of the stator has one spiral more than does the motor. To provide a stator that also remains functional under conditions where the fixed connection between the lining and the outer tube would be destroyed, e.g. due to chemical influences or high temperatures, the invention proposes that an inner tube provided with apertures is disposed in the lining, and that spacing strips are disposed between outer tube and inner tube.

12 Claims, 7 Drawing Sheets

STATOR FOR AN ECCENTRIC SCREW PUMP OR AN ECCENTRIC WORM MOTOR OPERATING ON THE MOINEAU PRINCIPLE

BACKGROUND OF THE INVENTION

The invention relates to a stator for an eccentric screw pump or an eccentric worm motor having a stator, and includes an outer tube that is provided with a lining of rubber or a rubber-like material and has a hollow space or cavity, in the shape of a double or multiple spiral, for accommodating a rigid rotor that is also in the form of a spiral, whereby the spiral of the stator respectively has one spiral more than does the rotor.

The manner of operation of eccentric screw pumps and eccentric worm motors is also designated as the Moineau principle. From DE 44 03 598 A1 a stator of the aforementioned type is known according to which the lining is fixedly connected with the outer tube, i.e. via chemical bonding between the elastomeric lining and a metallic outer tube. With such a stator there exists the danger that the fixed connection between lining and outer tube becomes detached, primarily if during the operation the stator is subjected to high temperatures and/or chemical stresses.

There are rubber types, such as HNBR, fluoro rubbers, or silicone rubbers, which at temperatures of 160° C. and greater remain functional, yet even with these rubbers the rubber/metal connection can become problematic and can be destroyed during continuous use.

It is an object of the invention to provide a stator that remains functional even under those conditions where the fixed connection between the lining and the outer tube would be destroyed, e.g. by chemical influences or high temperatures.

SUMMARY OF THE INVENTION

This object is inventively realized in that an inner tube that is provided with apertures is disposed in the lining.

The elastomeric material of the lining interlocks with the inner tube by penetrating through the apertures. This results in a positive connection between the individual components of the stator that is far more suitable to withstand the described stresses than is a chemical rubber/metal connection, for example via an adhesive agent.

Pursuant to an advantageous embodiment of the invention, spacing strips are disposed between outer tube and inner tube. In so doing, the elastomeric material of the lining can penetrate not only through the apertures of the inner tube. In addition, at least in the region between the spacing strips, the elastomeric material can surround the inner tube and in these regions has a laminar contact to the outer tube.

The inner tube can be connected with the outer tube, e.g. via weldings at the end faces or at bores that extend through the outer tube.

As a consequence of the spacing strips, a particularly fixed and reliable connection is achieved between the components of the stator without having to significantly increase the expense during the manufacture of the stator and with respect to the components that are used. The stator is generally produced in such a way that the elastomeric material that is intended to form the lining is introduced into the outer tube by spraying or injection, whereby the inner tube is already disposed in the outer tube. In this connection, the spacing strips prevent the inner tube from being displaced toward the outer tube due to the pressure of the spraying or injection. The spacing strips ensure that adequate space remains between outer tube and inner tube for being filled by the elastomeric material, which penetrates through the apertures in the inner space, whereby undercuts result that provide for a very good positive connection with the inner tube.

Pursuant to one possible embodiment of the invention, the spacing strips can be linear, flat profiled elements that extend in the direction of the longitudinal direction of the stator and practically extend over the greatest portion of its length, whereby a plurality of such spacing strips are distributed over the periphery of the inner tube.

Pursuant to another possible embodiment of the invention, the spacing strips can be annular or ring shaped, and surround the periphery of the inner tube, whereby a plurality of such rings can be disposed on a stator such that they are spaced from one another in the longitudinal direction.

Pursuant to a further embodiment of the invention, the spacing strips can have a spiral or helical configuration. This embodiment has the advantage that a single spacing strip of this type can already be sufficient.

A similar interlocking between the elastomeric material of the lining and the inner tube can also be achieved by a further embodiment of the invention where the inner tube that is provided with apertures has a wavy configuration, whereby it is immaterial whether the wave shape is selected in the axial or radial direction of the inner tube.

The selection of a specific shape of the cross-section of the strip or strips is not limited. For example, round, square and/or rectangular spacing strips can be utilized.

BRIEF DESCRIPTION OF THE DRAWINGS

Further details of the invention will be explained with the aid of the drawings, which illustrate exemplary embodiments of the invention.

The drawings show.

DESCRIPTION OF SPECIFIC EMBODIMENTS

Figure 1:
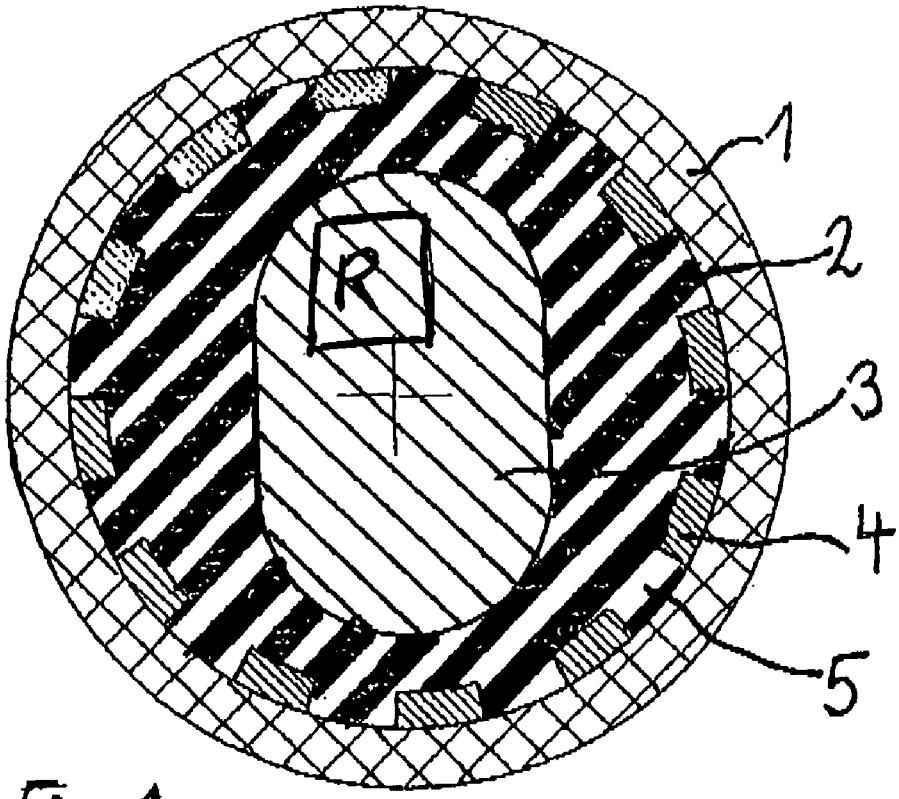
FIG. 1 a cross-section through one exemplary embodiment of an inventive stator, FIG. 2 a cross-section of another embodiment of the inventive stator, FIG. 3 a perspective illustration of a portion of the outer and inner tubes of a stator according to claim 2, with partially exposed layers, FIG. 4 the perspective illustration of a further embodiment, with partially exposed layers, FIG. 5 the perspective illustration of a further inventive embodiment, with partially exposed layers, FIG. 6 a longitudinal cross-section through the end portion of a stator according to claim 2, FIG. 7 a longitudinal cross-section through the end portion of a stator according to claim 2 in an embodiment modified relative to FIG. 6, FIG. 8 a cross-section through a further embodiment of an inventive stator, FIG. 9 a longitudinal cross-section through a further embodiment of an inventive stator, and FIG. 10 a further embodiment of a stator.

The stator illustrated in FIG. 1 has an outer tube 1 of a solid material (e.g. steel), in the interior of which is disposed a lining 2 of rubber or a rubber-like material. The lining 2 has a passage or bore 3 that is merely crudely illustrated in the drawing. The bore 3 forms the space for accommodating the rotor R (not illustrated in detail) and the material being conveyed (hollow space or cavity of the pump), in the event that the stator is used with an eccentric screw pump, or the space for accommodating the flowing drive medium, in the event that the stator is part of a device used as a motor. The bore 3 extends over the entire length of the stator. It is wound in a double or multiple spiral, and serves for accommodating a here not-illustrated rotor. The forces that occur during use of the pump are absorbed by the lining 2 and are conveyed further to the outer tube 1, via which the mounting of the pump is effected. A fixed connection between outer tube 1 and lining 2 must therefore be provided.

The important thing is that an inner tube 4 is disposed in the outer tube 1 and is provided with a perforation or a plurality of apertures 5, and is fixedly connected with the outer tube 1. The apertures 5 are filled by the material of the lining 2. This results in a positive connection between outer tube 1 and lining 2, which prevents the lining 2 not only from shifting in the longitudinal direction but also from rotating about its axis. A connection between the outer tube and lining produced by vulcanization or adhesion can be dispensed with.

Figure 2:
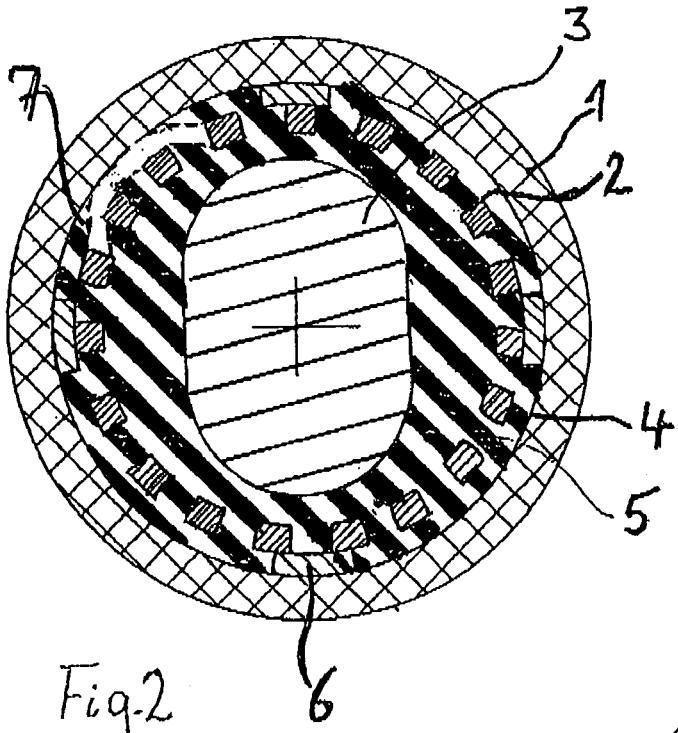
Figure 3:
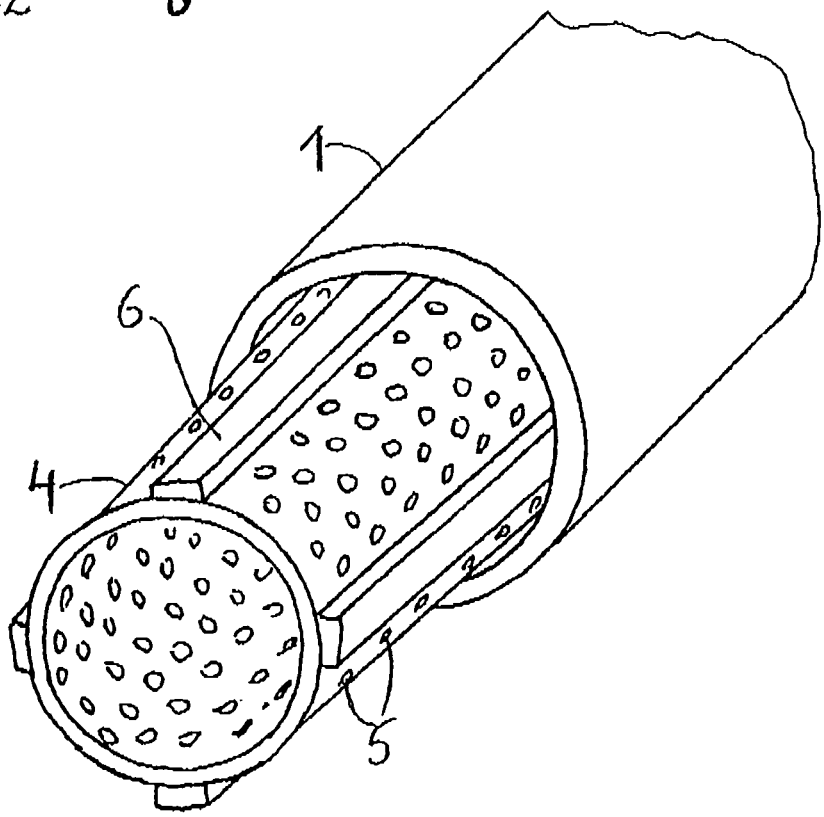

The stator of FIGS. 2 and 3 has the same components as does the stator of FIG. 1, although here spacers 6 are additionally disposed between the outer tube 1 and the inner tube 4. FIG. 2 shows the cross-section of the stator that is illustrated in perspective in FIG. 3. Four spacers 6 are shown in FIGS. 2 and 3; this number of spacers is merely an example.

The inner tube 4 can either comprise a tube that is provided with apertures, or can be formed from a conventional apertured sheet or plate that is cylindrically curved. To produce an inventive stator, the inner tube 4 and the spacers 6 are inserted into the outer tube 1. The rubber material of the lining 2 can subsequently be introduced by spraying or injection.

Figure 4:
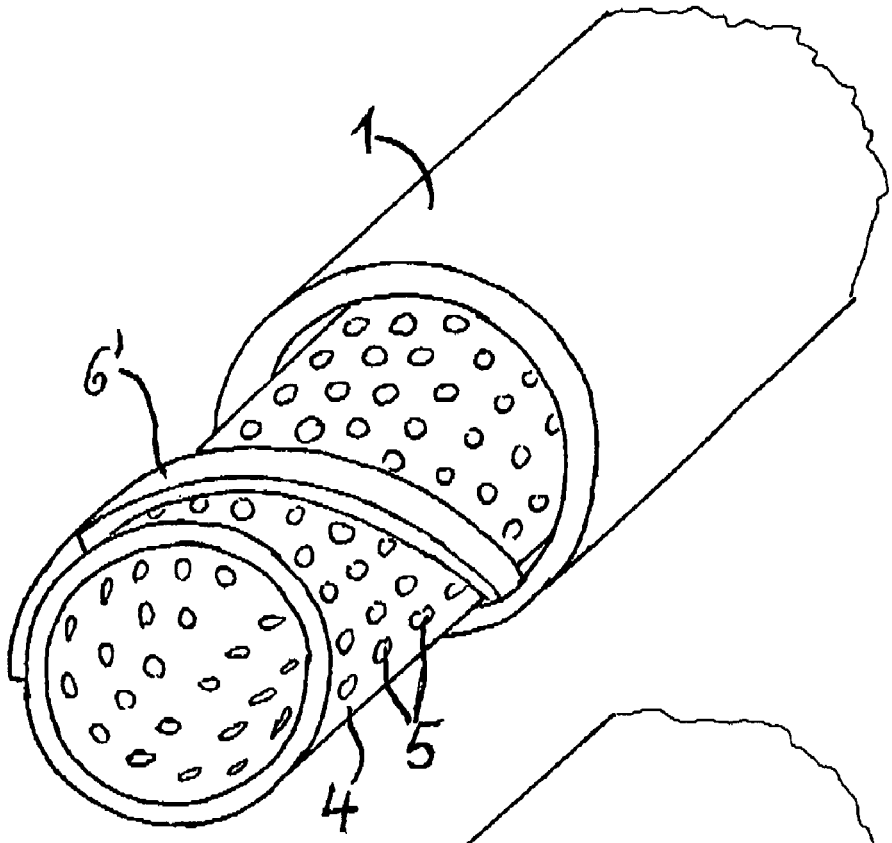
Figure 5:
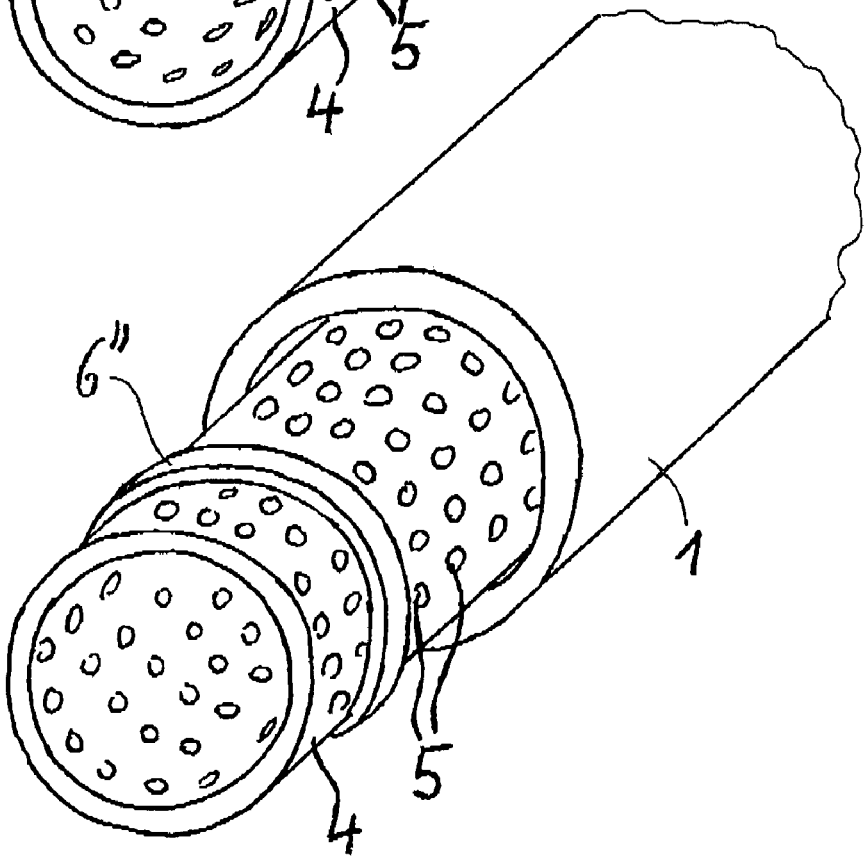

FIGS. 4 and 5 illustrate two possibilities of how the spacing strips 6', 6" can be disposed between the outer tube 1 and the inner tube 4. Whereas in FIG. 4 a spacing strip 6' helically surrounds the inner tube 4, in FIG. 5 a ring formed from the spacing strip 6" extends about the inner tube 4. It is, of course, to be understood that a plurality of rings 6" can be distributed about the inner tube 4 (here not illustrated). In addition, it is not mandatory to use only a single spacing strip 6' that helically surrounds the inner tube 4. Pursuant to the invention, two or more spacing strips can also be applied.

Figure 6:
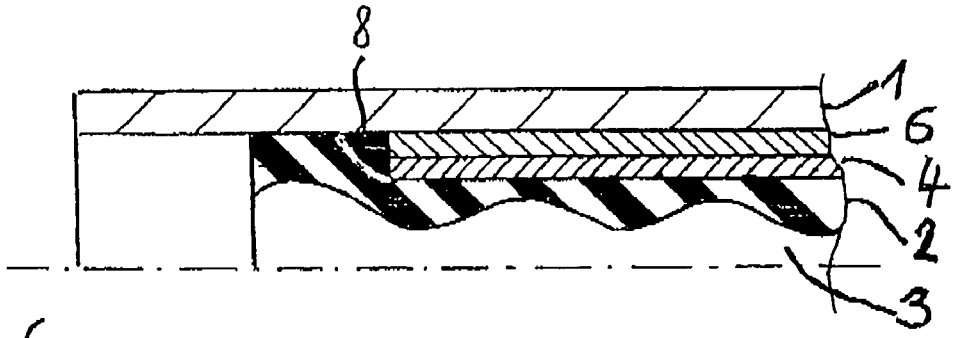
Figure 7:
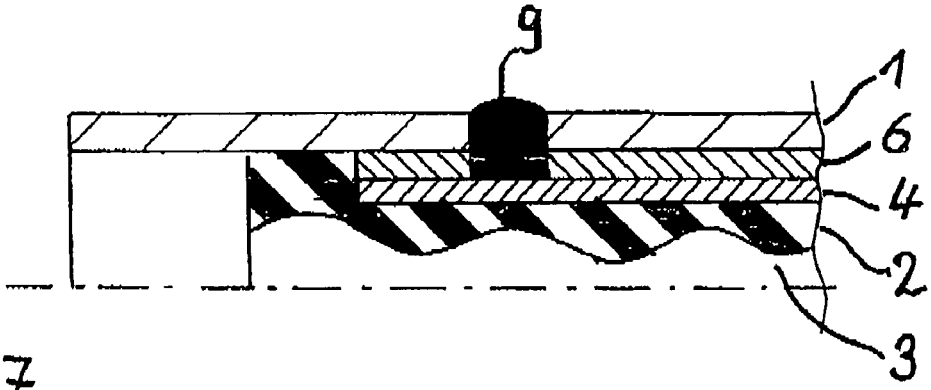

FIGS. 6 and 7 illustrate two possibilities for connecting the outer tube 1 with the inner tube 4. The connection can be effected by a welding 8, at the end faces, which interconnects the ends of the inner tube 4 and the spacer or spacing strips 6, and connects the ends with the inner side of the outer tube 1 (FIG. 6). If the embodiment of FIG. 5 is selected, and the annular or ring-shaped spacing strips 6" are placed in a flush manner at the end of the inner tube 4 (not illustrated), a radially closed welding of the inner tube 4 and the spacing strips 6" is even possible.

Alternatively, or in addition, the connection can be effected by point-type welding 9 that at various locations distributed over the periphery and the longitudinal extension of the stator is introduced into bores that extend through the outer tube 1 and the spacing strips 6 (FIG. 7).

Pursuant to a further, here not separately illustrated embodiment of the invention, the outer tube 1 and the inner tube 4 can be interconnected via a press fit. It is to be understood that the connecting techniques mentioned here can also be used if merely an inner tube is used, in other words, without the spacing strips 6, 6', or 6", as illustrated in FIG. 1.

Figure 10:
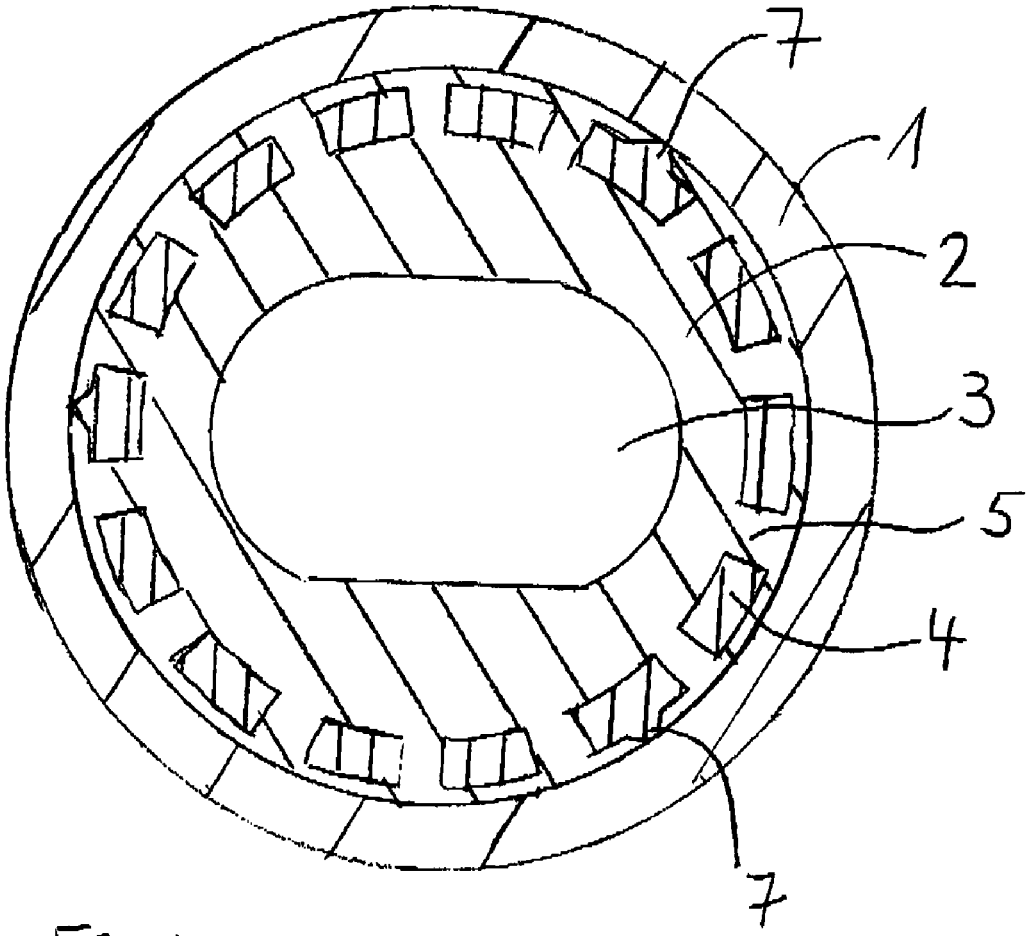

Pursuant to a further embodiment of the invention, illustrated here in FIG. 10, the inner tube 4 is provided with raised portions or elevations 7 that extend outwardly, in other words, in the direction toward the outer tube 1. These elevations provide for the desired spacing relative to the outer tube 1, so that the spacing strip or strips 6 can be eliminated. The elastomeric material of the lining 2 can then also surround the inner tube.

Figure 8:
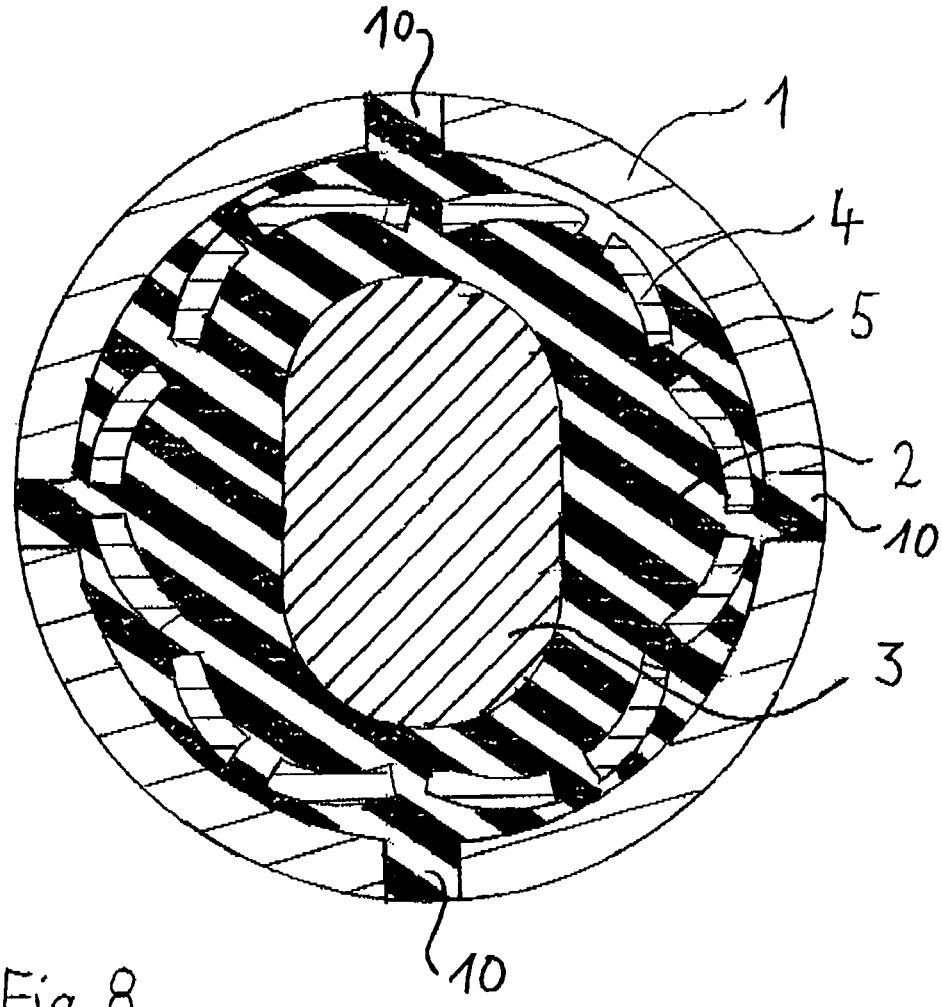
Figure 9:
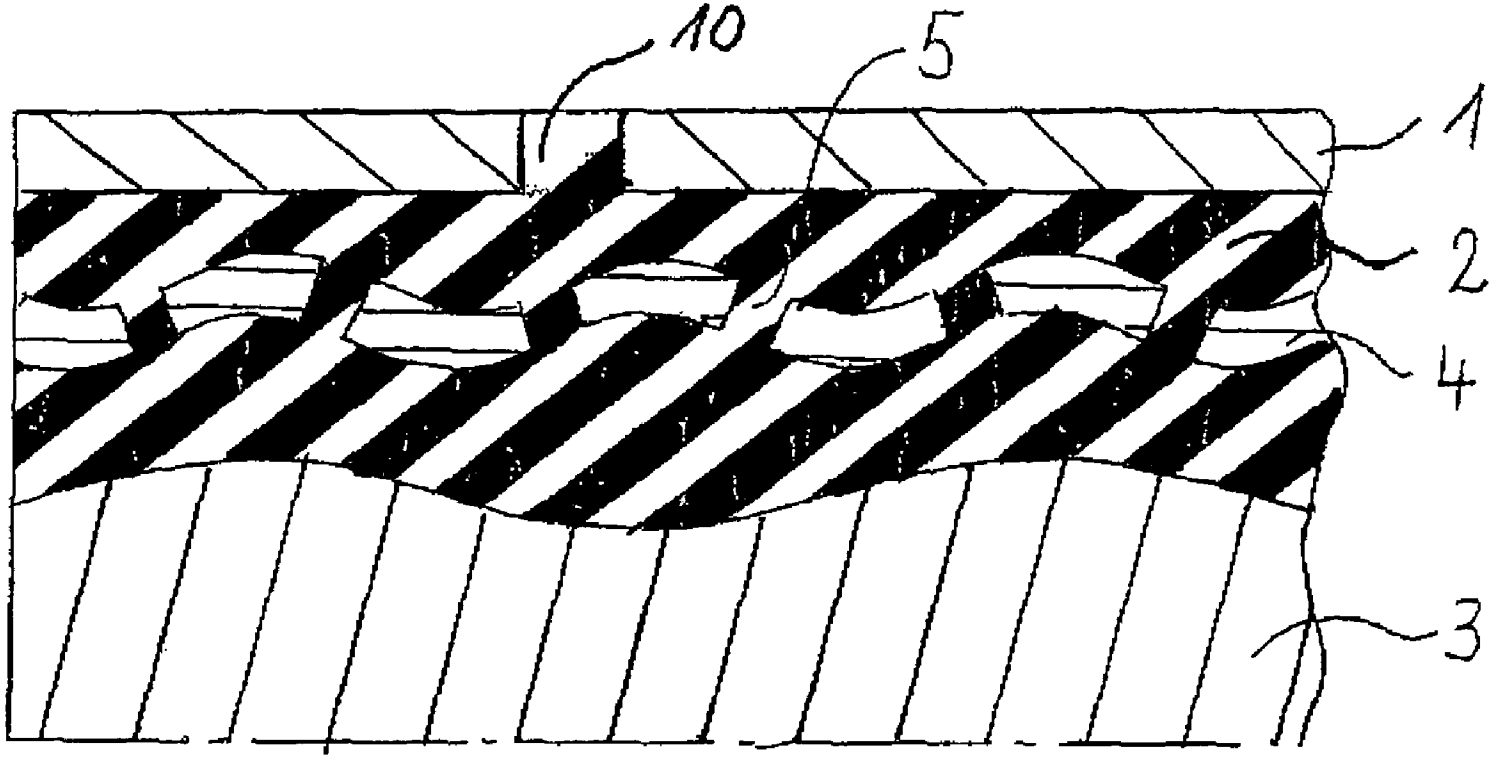

The spacing strip or strips can also be dispensed with if the inner tube has a wavy or undulating configuration. Such a special embodiment is illustrated in FIG. 8. Here the wave shape of the inner tube 4 proceeds in the circumferential direction, whereas FIG. 9 illustrates a stator where the inner tube 4 is deformed in a wavy manner in the axial direction. Here also the elastomeric mass surrounds the inner tube. The wavy shape could also proceed in a helical manner about the longitudinal axis of the stator (here not illustrated).

In addition to the apertures 5 that are provided in the inner tube 4, the outer tube 1 can also be provided with apertures 10, as illustrated by way of example in FIGS. 8 and 9.

The present invention is, of course, in no way restricted to the specific disclosure of the specification and drawings, but also encompasses any modifications within the scope of the appended claims.

The invention claimed is:

1. A stator for an eccentric screw pump or an eccentric worm motor having a stator, comprising:

an outer tube that is provided with a lining of elastomeric material and has a hollow space or cavity, in the shape of a double or multiple spiral, for accommodating a rigid rotor that is also in the form of a spiral, wherein said spiral of said stator has one spiral more than does said rotor, and an inner tube disposed in said lining, wherein said inner tube is provided with apertures for receiving portions of said lining.

2. A stator according to claim 1, wherein at least one spacing strip is disposed between said inner tube and said outer tube.

3. A stator according to claim 2, wherein said at least one spacing strip is disposed essentially parallel to a longitudinal axis of said stator.

4. A stator according to claim 2, wherein said at least one spacing strip is helically disposed about a periphery of said inner tube, and extends in the direction of a longitudinal axis of said inner tube.

5. A stator according to claim 2, wherein said at least one spacing strip essentially extends in a circumferential direction of said stator and annularly surrounds said inner tube.

6. A stator according to claim 2, wherein said at least one spacing strip, is made of at least one of the materials consisting of polymeric material, elastomeric material, and metal.

7. A stator according to claim 1, wherein said inner tube has a wavy configuration.

8. A stator according to claim 1, wherein end faces of said inner tube are welded to said outer tube.

9. A stator according to claim 1, wherein said outer tube and said inner tube are interconnected via point-type weldings, and wherein said weldings are introduced into bores that extend through said outer tube.

10. A stator according to claim 1, wherein said outer tube is provided with apertures.

11. A stator according to claim 1, wherein said inner tube is provided with elevations that extend outwardly in a direction toward said outer tube.

12. A stator according to claim 1, wherein said inner tube is disposed against said outer tube.

* * * * *